US008393706B2

(12) United States Patent
Haba

(10) Patent No.: US 8,393,706 B2
(45) Date of Patent: Mar. 12, 2013

(54) CONVEYING APPARATUS, RECORDING APPARATUS, AND CONVEYING METHOD

(75) Inventor: Shinji Haba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 13/011,220

(22) Filed: Jan. 21, 2011

(65) Prior Publication Data

US 2011/0205278 A1 Aug. 25, 2011

(30) Foreign Application Priority Data

Feb. 24, 2010 (JP) ..... 2010-039140

(51) Int. Cl.
*B41J 29/38* (2006.01)

(52) U.S. Cl. ..... 347/16

(58) Field of Classification Search ..... 347/16, 347/101, 104

See application file for complete search history.

(56) References Cited

U.S. PATENT DOCUMENTS 5,820,283 A * 10/1998 Sunada et al. ..... 400/642
7,896,459 B2 * 3/2011 Sano et al. ..... 347/16

FOREIGN PATENT DOCUMENTS

JP 11-105360 A 4/1999
JP 2000-355448 A 12/2000
JP 2003-195424 A 7/2003

* cited by examiner

*Primary Examiner* — An Do
(74) *Attorney, Agent, or Firm* — Global IP Counselors, LLP

(57) ABSTRACT

A conveying apparatus includes a holding part that holds a recording medium in the form of a roll and rotates, a clamping unit that clamps the recording medium downstream from the holding part along a conveying route, a regulating member that regulates a position of a side end of the recording medium in a width direction intersecting the conveying direction between the holding part and the clamping unit in the conveying route, a drive unit that rotatably drives the holding part in a forward direction to unwind the recording medium and a reverse direction to rewind the recording medium, and a controller that controls a drive state of the drive unit. The controller controls the drive unit so that, after the holding part is driven forward, the holding part is driven in reverse.

6 Claims, 2 Drawing Sheets

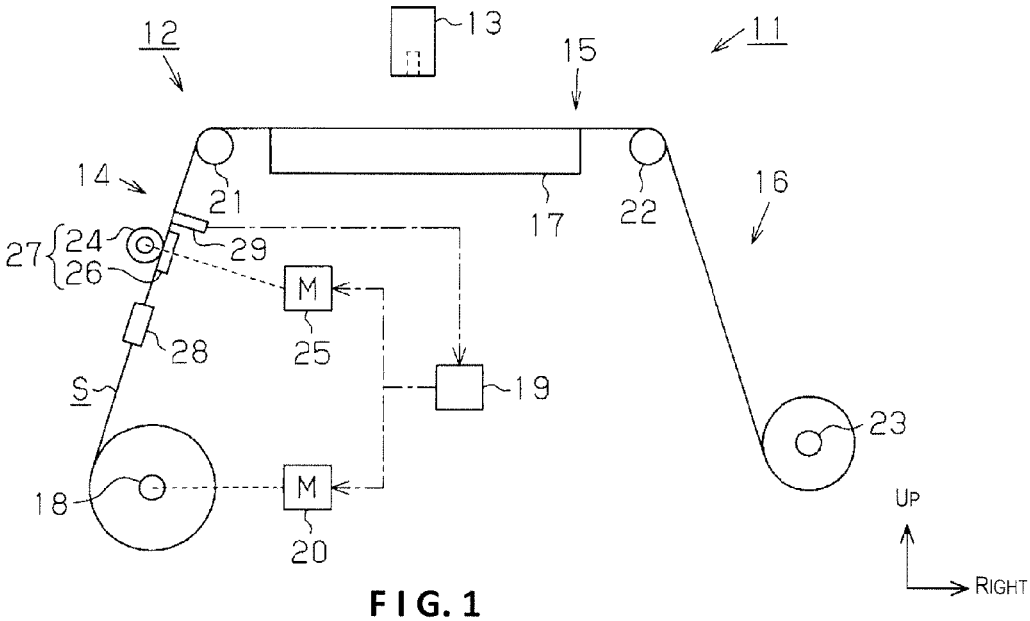
FIG. 1
FIG. 2A
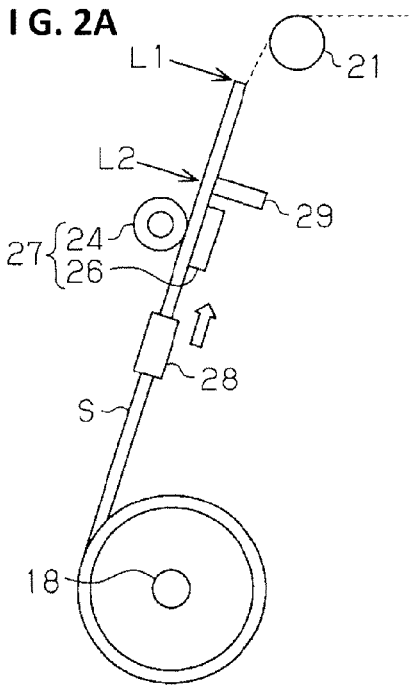
FIG. 2B
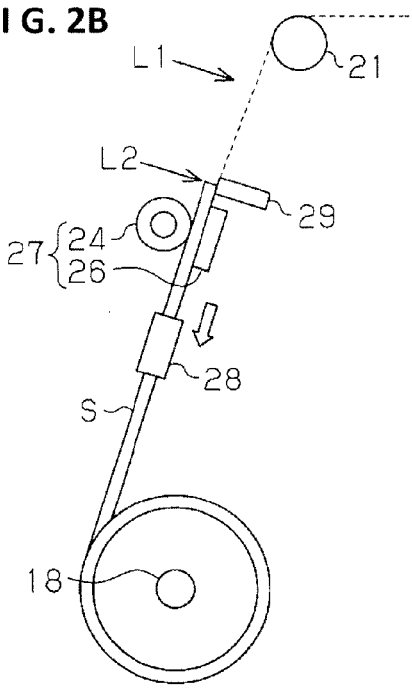

CONVEYING APPARATUS, RECORDING APPARATUS, AND CONVEYING METHOD

CROSS-REFERENCE TO RELATED APPLICATIONS

This application claims priority to Japanese Patent Application No. 2010-039140 filed on Feb. 24, 2010. The entire disclosure of Japanese Patent Application No. 2010-039140 is hereby incorporated herein by reference.

BACKGROUND

1. Technical Field

The present invention relates to a conveying apparatus, a recording apparatus, and a conveying method.

2. Related Art

Conventionally, in a recording apparatus which performs recording on a conveyed recording medium, to prevent recording from being performed in a state in which the distal end of the recording medium is at an incline, skew correction for correcting the skew (the oblique movement) of the recording medium is performed just before (upstream) recording is performed (Japanese Laid-Open Patent Application No. 2003-195424, for example).

In the recording apparatus according to Japanese Laid-Open Patent Application No. 2003-195424, the skew of the roll medium is corrected by bringing the distal end of the recording medium in contact with a pair of conveying rollers which are disposed upstream of the recording portion where recording is performed and which are stopped from rotating. That is, the rectangular recording medium is conveyed until the distal end of the recording medium comes in contact between the rollers of the pair of conveying rollers which are stopped from rotating. At this time, when there is a skew in the recording medium, the leading corner of the recording medium comes in contact between the rollers of the pair of conveying rollers. Further conveying pushes the recording medium in between the rollers, forming a flexure, whereby the other corner is pushed in between the rollers of the roller pair, and the entire distal end of the recording medium therefore comes in contact between the rollers and takes on an appropriate form.

SUMMARY

The skew correction of the recording medium in the recording apparatus of Japanese Laid-Open Patent Application No. 2003-195424 presumes that the distal end of the recording medium brought in contact with the pair of conveying rollers is perpendicular to the ends on both sides in the width direction of the recording medium. However, the distal end of the recording medium is not necessarily perpendicular, and in cases in which skew correction is performed by bringing a recording medium whose distal end is not perpendicular in contact with the conveying rollers, there is a risk of creating a state in which further skewing readily occurs.

The present invention was devised in view of the problems described above, and an object thereof is to provide a conveying apparatus, a recording apparatus, and a conveying method in which skew correction can be performed on a recording medium regardless of the shape of the distal end.

To achieve the objects described above, the conveying apparatus according to a first aspect of the present invention includes a holding part, a clamping unit, a regulating member, a drive unit and a controller. The holding part holds a rectangular recording medium in the form of a roll wound up in a roll shape, the holding part being configured to rotate integrally with the roll about an axis of the roll. The clamping unit clamps the recording medium downstream from the holding part along a conveying route to convey the recording medium, the recording medium being clamped between a roller member configured to rotate while in contact with one surface of the recording medium and a contact member configured to come in contact with the other surface of the recording medium. The regulating member regulates a position of a side end of the recording medium in a width direction intersecting the conveying direction by coming in contact with the side end of the recording medium between the holding part and the clamping unit in the conveying route. The drive unit is configured to rotatably drive the holding part in a forward direction to unwind the recording medium from the roll and a reverse direction to rewind the recording medium into the roll. The controller controls a drive state of the drive unit so that, after the holding part is driven forward until a leading edge of the recording medium reaches a first conveying position downstream from the clamping unit, the holding part is driven in reverse until the leading edge of the recording medium moves from the first conveying position and reaches a second conveying position downstream from the clamping unit and upstream from the first conveying position.

According to the aspect described above, the recording medium can be corrected to the proper conveyed orientation by conveying the rectangular recording medium in the reverse direction while tension is applied by the clamping unit and bringing the side ends of the recording medium in the width direction intersecting the conveying direction in contact with the guide member. Therefore, skewing of the recording medium can be corrected without shifting the shape of the leading edge of the recording medium to the left or right.

In the conveying apparatus according to a second aspect, the roller member is preferably driven to rotate in order to convey the recording medium along the conveying route from the upstream side to the downstream side in the forward direction when the drive unit drives forward, and the drive rotation of the roller member is cancelled when the drive unit drives in reverse, allowing the roller member to be rotatably driven so as to rotate on making contact with the recording medium conveyed along the conveying route from the downstream side to the upstream side in the reverse direction.

According to the aspect described above, when the recording medium is conveyed in the reverse direction, since the roller member in contact with one surface of the recording medium is driven to rotate by being turned, scratching by the roller member on the one surface of the recording medium on which recording is performed can be suppressed while the appropriate tension is applied to the recording medium by the reverse driving of the drive unit.

The conveying apparatus according to a third aspect, a detecting unit is further preferably provided to detect a position of the leading edge of the recording medium. The controller preferably controls the drive unit on the basis of detection results obtained from the detecting unit.

According to the aspect described above, since the controller performs skew correction on the basis of detection information on the leading edge of the recording medium sent from the detecting unit, the conveying of the recording medium in both the forward direction and the reverse direction can be stabilized.

The conveying apparatus according to a fourth aspect, a conveying roller is further preferably provided to convey the recording medium in the forward direction by being rotatably driven while in contact with the recording medium between the clamping unit and the holding part in the conveying route.

When the drive unit drives in reverse, the drive rotation of the conveying roller is cancelled and the conveying roller being rotatably driven so as to rotate due to contact with the recording medium conveyed in the reverse direction.

According to the aspect described above, when the recording medium is wound back up, the conveying roller provided between the holding part and the clamping unit is driven to rotate by being turned while in contact with one surface of the recording medium, similar to the roller member of the clamping unit, and scratching of the recording medium by the conveying roller can therefore be suppressed.

A recording apparatus according to a fifth aspect includes a recording head configured to perform recording on the recording medium, and the conveying apparatus configured as described above.

According to the aspect described above, the same operational effects as those of the conveying apparatus described above can be achieved with the recording apparatus.

To achieve the objects described above, the conveying method according to a sixth aspect of the present invention is a conveying method in a conveying apparatus configured to convey a rectangular recording medium in both a forward direction from an upstream side to a downstream side along a conveying route and a reverse direction from a downstream side to an upstream side. The conveying method includes: rotating a holding part, which holds the recording medium in the form of a roll wound up into a roll shape and rotates integrally with the roll, about an axis of the roll in a forward direction for conveying the recording medium in the forward direction to convey the recording medium until a leading edge of the recording medium reaches a first conveying position farther downstream in the conveying route than a clamping unit that clamps the recording medium downstream in the conveying route from the holding part; and rotating the holding part in a reverse direction for conveying the recording medium in the reverse direction while a regulating member is brought in contact with a side end of the recording medium in a width direction intersecting the conveying direction between the holding part and the clamping unit in the conveying route, so that the position of the side end of the recording medium is regulated, whereby the recording medium is conveyed until the leading edge of the recording medium moves from the first conveying position and reaches a second conveying position downstream from the clamping unit and upstream from the first conveying position.

According to the aspect described above, it is possible to achieve the same operational effects as those of the conveying apparatus described above.

BRIEF DESCRIPTION OF THE DRAWINGS

Referring now to the attached drawings which form a part of this original disclosure:

FIG. 1 is a schematic front view of the recording apparatus in the embodiment;

FIG. 2A is a schematic enlarged view showing continuous paper being conveyed in a forward direction, 2B is a schematic enlarged view showing continuous paper being conveyed in a reverse direction.

DETAILED DESCRIPTION OF EXEMPLARY EMBODIMENTS

Figure 3:
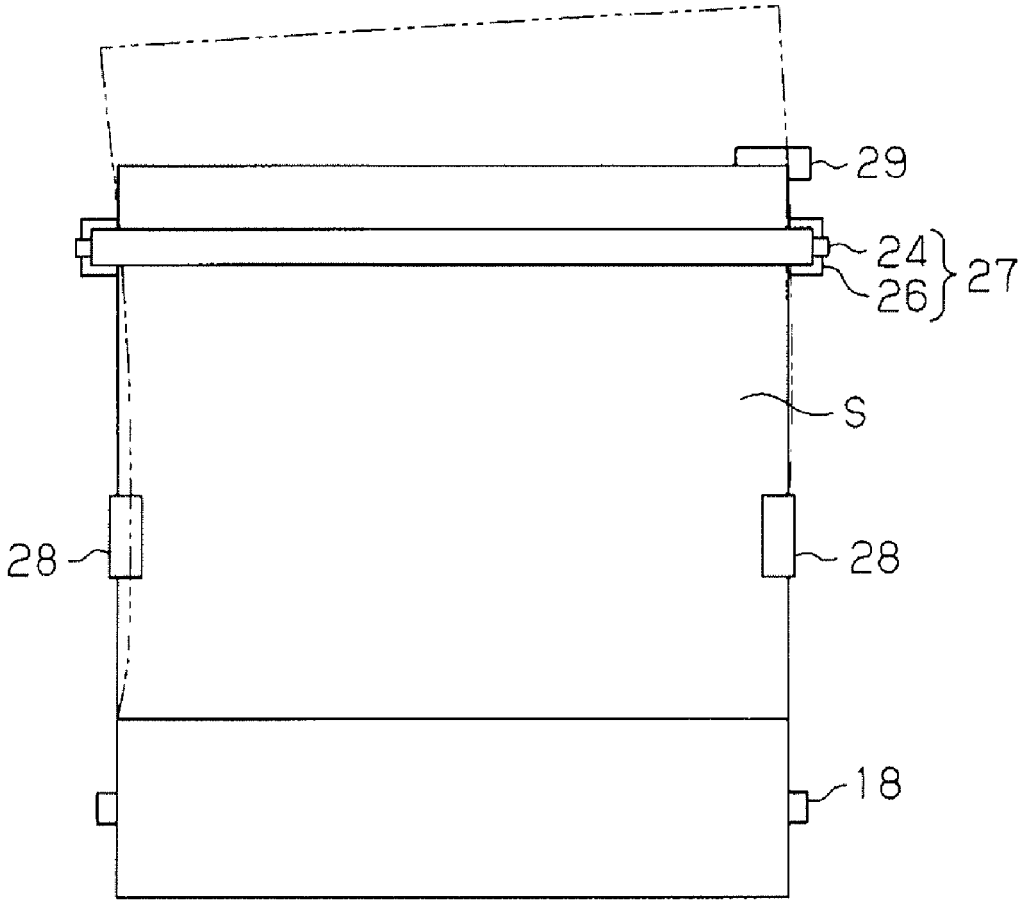
FIG. 3 is a schematic plan view of the conveying apparatus.

An embodiment is described hereinbelow according to FIG. 1, wherein the present invention is specified as an inkjet recording apparatus (hereinbelow shortened to "recording apparatus"), which is one type of a recording apparatus, and a target conveying apparatus (hereinbelow shortened to "conveying apparatus") included in the same recording apparatus. In the description hereinbelow, when the "up-down direction" and the "left-right direction" are mentioned, they are referencing the "up-down direction" and the "left-right direction" in FIG. 1. Likewise, when the "forward-backward direction" is mentioned, "forward" refers to the foreground of the direction orthogonal to the image plane of FIG. 1, and "backward" refers to the background of the same direction.

A recording apparatus 11 comprises a conveying apparatus 12 for conveying continuous paper S as a rectangular recording medium, and a substantially rectangular recording head 13 disposed above the conveying apparatus 12 so as to face the conveying apparatus 12, as shown in FIG. 1. The recording head 13, which extends in a direction orthogonal to the conveying direction of the continuous paper S, is supported on the underside of a guide rail (not shown) whose length in the longitudinal direction corresponds to the maximum paper width of the continuous paper S, and is capable of moving back and forth in a direction orthogonal to the conveying direction of the continuous paper S along the guide rail on the basis of the driving of a drive mechanism (not shown). The recording head 13 is designed to perform recording by spraying ink as a liquid midway in the conveying route onto a recording area of the continuous paper S being conveyed by the conveying apparatus 12.

The conveying apparatus 12 is configured from an unwinding portion 14 for unwinding the continuous paper S onto the conveying route, a recording portion 15 where recording is performed at a position facing the recording head 13 by spraying ink onto the continuous paper S supplied from the unwinding portion, and a winding portion 16 for winding the continuous paper S on which recording has been performed in the recording portion 15. The recording portion 15 is also provided with a rectangular plate-shaped platen 17 capable of supporting the continuous paper S. That is, in the conveying direction of the continuous paper S, the unwinding portion 14 is set up in a position near the left, which is upstream, and the winding portion 16 is set up in a position near the right, which is downstream. The recording portion 15 is set up in a position midway along the conveying route between the unwinding portion 14 and the winding portion 16.

A winding shaft 18 extending in the forward-backward direction is rotatably provided to the unwinding portion 14, as shown in FIG. 1. The continuous paper S is held on the winding shaft 18 in the form of a roll wound up in a roll shape in advance, and is capable of integrally rotating about the axial line of the winding shaft 18. In this respect, the winding shaft 18 functions as a holding part which holds the continuous paper (recording medium) S as a roll and which can rotate integrally with the roll. The winding shaft 18 is configured so as to rotate forward and convey and unwind (unreel) the continuous paper S held on the winding shaft 18 in a forward direction when a first drive motor 20 as a drive unit of the winding shaft 18 drives forward based on a control signal from a controller 19, and to rotate in reverse and wind the continuous paper S back up in a reverse direction when the first drive motor 20 drives in reverse. That is, the winding shaft 18 is designed to convey the continuous paper S downstream in the forward direction when rotating in a forward direction (clockwise in FIGS. 1 and 2) due to the forward drive force of the first drive motor 20, and to convey the continuous paper S upstream in a reverse direction when rotating in a reverse direction (counterclockwise in FIGS. 1 and 2) due to the reverse drive force of the first drive motor 20.

Thus, in the present embodiment, the drive state of the first drive motor (drive unit) 20 is controlled by the controller 19.

In a position above and to the right of the winding shaft 18 and to the left of the platen 17, a first intermediary roller 21 is rotatably provided extending in the forward-backward direction so as to hold up the continuous paper S unwound from the winding shaft 18 and guide the continuous paper S toward the recording portion 15. The first intermediary roller 21 is designed to change the conveying direction of the continuous paper S to a horizontal direction by holding up the continuous paper S unwound from the winding shaft 18 from the lower left.

To the right of the platen 17, a second intermediary roller 22 which faces the left-hand side (upstream-side) first intermediary roller 21 across the platen 17 in the left-right direction is provided so as to extend in the forward-backward direction while being parallel with the first intermediary roller 21. The respective positions where the first intermediary roller 21 and the second intermediary roller 22 are disposed are adjusted so that the peaks of their respective circumferential surfaces are at the same height as the supporting surface, which is the top surface of the platen 17. Therefore, after the continuous paper S, whose conveying direction has been changed to the horizontal direction by the first intermediary roller 21, is conveyed downstream to the right while sliding over the supporting surface of the platen 17, the continuous paper S is held up on the second intermediary roller 22 from the upper right, whereby the conveying direction of the continuous paper S is changed from the horizontal right direction to a right declined direction.

The winding portion 16 is set up to the right of the second intermediary roller 22, and a winding shaft 23 is provided at the bottom of the winding portion 16 (below and to the right of the second intermediary roller 22). The winding shaft 23 is designed so as to rotate based on the drive force of a drive motor (not shown), and the distal end of the continuous paper S, which is the end downstream in the conveying direction, is wound around the winding shaft 23.

In a position in the unwinding portion 14 of the conveying apparatus 12, upstream in the conveying direction from the first intermediary roller 21, a conveying drive roller 24 as a roller member capable of being rotatably driven is provided so as to extend in the forward-backward direction while being parallel with the first intermediary roller 21, as shown in FIG. 1. Coupled with the conveying drive roller 24 is a second drive motor 25 which functions as a drive unit for rotatably driving the conveying drive roller 24 in the counterclockwise direction in FIGS. 1 and 2. Furthermore, in a position opposite the conveying drive roller 24 from the other side of the continuous paper S, a contact plate 26 is disposed as a substantially rectangular contact member composed of a metal material. That is, this contact plate 26 is disposed so that a flat plate surface thereof extends in the forward-backward direction, the plate surface being capable of sliding against one side of the continuous paper S moving in the conveying direction while its other side is in contact with the conveying drive roller 24, and the contact plate 26 is designed so as to clamp the continuous paper S in cooperation with the conveying drive roller 24. In this respect, in the present embodiment, a clamping unit 27 for clamping the continuous paper (recording medium) S is configured from the conveying drive roller 24 and the contact plate 26.

When the second drive motor 25 rotatably drives based on a control signal from the controller 19, the conveying drive roller 24 is driven to rotate based on the drive force, thereby conveying the continuous paper S unwound from the winding shaft 18 in the forward direction while clamping the continuous paper S in cooperation with the contact plate 26. When the second drive motor 25 stops driving based on a control signal from the controller 19, the conveying drive roller 24 rotates freely without being driven to rotate by the motor, and the conveying drive roller 24 is thereby driven to rotate by being turned by the continuous paper S, which is being conveyed in the opposite direction of the conveying direction while maintaining a state of contact under friction with the conveying drive roller.

Furthermore, a pair of guide members 28 formed so as to have a U-shaped cross section (not shown) as seen from the conveying direction are provided in a position upstream from the winding shaft 18 and downstream from the clamping unit 27. The guide members 28 are disposed in positions corresponding to the side ends of the continuous paper S in the width direction orthogonal to the conveying direction (positions symmetrical about a center line in the width direction of the continuous paper S). The concave inside surfaces in the guide members 28 are in slidable contact with the side ends in the width direction of the continuous paper S unwound from the winding shaft 18, whereby the positions of the side ends in the width direction of the continuous paper S are regulated. That is, the guide members 28 function as regulating members for guiding (regulating) the positions of the side ends of the continuous paper S by their inside surfaces sliding against the side ends of the continuous paper S.

A sensor 29 as a detecting unit for detecting the leading edge of the continuous paper S is provided to a position upstream from the first intermediary roller 21 and slightly downstream from the conveying drive roller 24. The sensor 29 is configured from a reflective optical sensor comprising a light-emitting element and a receiving element for detecting reflected light of the light emitted by the light-emitting element. The sensor 29 sends an ON detection signal to the controller 19 when the continuous paper S has been detected, and sends an OFF detection signal to the controller 19 when the continuous paper S has not been detected. Therefore, the timing at which the leading edge of the continuous paper S passes through can be detected by sensing the state of the detection signal of the sensor 29 and the timing at which the detection signal changes.

The controller 19 is electrically connected to the first drive motor 20, the second drive motor 25, and the sensor 29. The controller 19 is configured from a digital computer comprising a CPU (not shown) for performing various computations by functioning as a central processing unit, a ROM (not shown) functioning as storage means, a RAM (not shown), and other components. The storage unit stores the detection results of the leading edge of the continuous paper S and other information inputted from the sensor 29, and also records the programs whereby the controller 19 performs the various controls. The controller 19 controls the first drive motor 20 and the second drive motor 25 on the basis of the information of the sensor 29. That is, the controller 19 controls the first drive motor 20 so that the winding shaft 18 is driven forward and also controls the second drive motor 25 so that the conveying drive roller 24 is driven to rotate, until a predetermined time has elapsed after the sensor 29 detects the leading edge of the continuous paper S. After the predetermined time has elapsed following the detection of the leading edge of the continuous paper S by the sensor 29, the first drive motor 20 is controlled so that the winding shaft 18 is rotatably driven in reverse and the second drive motor 25 is controlled so as to stop driving the conveying drive roller 24, until the sensor 29 again detects the leading edge of the continuous paper S.

The operation of the recording apparatus 11 configured as described above are described next, focusing particularly on the skew correction of the continuous paper S in the conveying apparatus 12. The term "skew correction" used herein refers to performing positional correction on the continuous paper S so that the side ends of the continuous paper S become aligned parallel with the conveying direction. That is, to appropriately perform recording on the continuous paper S, the continuous paper S must be supplied in a state of alignment relative to the recording portion 15, but since the side ends of the continuous paper S sometimes move obliquely as being non-parallel to the conveying direction during the unwinding or conveying process, positional correction of the continuous paper S is performed in a position upstream from the recording portion 15.

In the recording apparatus 11, when the controller 19 receives (by transmission) a supply-paper command, the winding shaft 18 and the conveying drive roller 24 are rotatably driven, whereby the continuous paper S is unwound from the winding shaft 18 and begins to be conveyed in the forward direction from the upstream side toward the downstream side. When the leading edge of the continuous paper S passes through the guide members 28 and reaches the conveying drive roller 24, the continuous paper S is conveyed further downstream while being clamped between the conveying drive roller 24 and the contact plate 26, and the leading edge of the continuous paper S is detected by the sensor 29. After the leading edge of the continuous paper S has been detected by the sensor 29, the continuous paper S is conveyed in the forward direction indicated by the white arrow until a predetermined time has elapsed, as shown in FIG. 2A (forward conveying stage).

When the predetermined time has thereafter elapsed and the leading edge of the continuous paper S reaches a first conveying position L1 located farther downstream than the conveying drive roller 24, the winding shaft 18 and the conveying drive roller 24 cease to be rotatably driven. Next, the winding shaft 18 begins to rotate in the reverse direction and the rotatable driving of the conveying drive roller 24 is cancelled. The continuous paper S is then conveyed in the reverse direction indicated by the white arrow as shown in FIG. 2B (reverse conveying stage), until the leading edge of the continuous paper S reaches a second conveying position L2 where it will be detected again by the sensor 29. At this time, since the continuous paper S is conveyed in the reverse direction while being clamped between the conveying drive roller 24 and the contact plate 26 constituting the clamping unit 27 and while sliding against the plate surface of the contact plate 26, appropriate tension is applied to the continuous paper S by the clamping unit 27. Furthermore, since the conveying drive roller 24 whose rotatable driving has been cancelled is then driven to rotate so as to turn along with the conveying of the continuous paper S in the reverse direction, even if the surface of the continuous paper S used as the recording process surface is in contact with the conveying drive roller 24, the recording process surface of the continuous paper S is not likely to be scratched.

While the continuous paper S is being conveyed in the reverse direction while under tension from the clamping unit 27, the widthwise side ends of the continuous paper S slide against the guide members 28. In cases in which the position of the continuous paper S is moving obliquely as shown in FIG. 3 (the state shown by the double-dotted lines in FIG. 3), the position is corrected so that the positions of the widthwise side ends of the continuous paper S are guided by the guide members 28 into alignment (the state shown by the solid lines in FIG. 3).

According to the embodiment described above, the following effects are achieved.

(1) The continuous paper S in the form of a roll is conveyed in the reverse direction while under appropriate tension by the clamping unit 27 and the widthwise side ends of the continuous paper S slide against the guide members 28, whereby the continuous paper S becomes aligned in a proper conveyed orientation. Therefore, skewing of the continuous paper S can be corrected without shifting the shape of the leading edge of the continuous paper S to the left or right.

(2) When the continuous paper S is conveyed in the reverse direction, since the conveying drive roller 24 is driven to rotate so as to be turned along with the conveying of the continuous paper S, scratching by the conveying drive roller 24 on the surface of the continuous paper S used as the recording process surface can be suppressed while the appropriate tension is applied to the continuous paper S.

(3) Since the controller 19 performs skew correction on the basis of detection information on the leading edge of the continuous paper S sent from the sensor 29, the conveying of the continuous paper S in both the forward direction and the reverse direction can be stabilized.

The embodiment described above may be modified as follows.

The recording head 13 may be a rectangular line head.

The rectangular recording medium is not limited to the continuous paper S and may be a continuous film or the like.

The conveying drive roller 24 may be a plurality of rollers divided in the width direction.

The contact plate 26 is not limited to metal, and may be made of a resin, a hard rubber, or the like. The shape is not limited to the plate shape of the contact plate 26, and a contact member may be configured from a roller or the like.

A conveying roller for conveying the continuous paper S in the forward direction by being rotatably driven while in contact with the continuous paper S may also be provided between the winding shaft 18 and the clamping unit 27. It is preferable that the driven rotation of the conveying roller in this case be cancelled when the winding shaft 18 is driven in reverse, and that the conveying roller be driven to rotate by being turned by contact with the continuous paper S conveyed in the reverse direction. With this type of configuration, the conveying roller is turned along with the conveying of the continuous paper S, similar to the conveying drive roller 24, and scratching of the continuous paper S by the conveying roller can therefore be suppressed.

The sensor 29 may be any other type of sensor as long as it can detect the leading edge of the continuous paper S. The sensor 29 also need not be provided.

The conveying drive roller 24 need not be driven to rotate as long as it can be rotated by contact with the continuous paper S.

In the embodiment described above, the recording apparatus was specified as the recording apparatus 11, but a recording apparatus that sprays or discharges a liquid other than ink may also be used. The present invention can be applied to various liquid-spraying apparatuses comprising a liquid spray head or the like for discharging microscopic droplets. The term "droplets" refers to the state of the liquid discharged from the recording apparatus, and includes that which leaves trails of grains, tears, or threads. The liquid referred to herein need only be a substance that can be sprayed by the recording apparatus. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing functional materials composed of pigments, metal particles, or the like which are dissolved, dispersed, or mixed in a solvent. Typical examples of the liquids include ink such as the ink described in the embodiment described above, liquid crystal, and the like. The term "ink" used herein includes common water-based ink and oil-based ink, as well as gel ink, hot melt ink, and other various liquid compositions. Specific examples of the recording apparatus include recording apparatuses which spray a liquid containing an electrode material, a coloring material, or the like in the form of a dispersion or a solvent, which is used in the manufacture of liquid crystal displays, EL (electroluminescence) displays, surface-emitting displays, color filters, and the like, for example; recording apparatuses which spray a biological organic substance used to manufacture biochips; recording apparatuses which are used as precision pipettes and which spray a liquid as a test sample; printing apparatuses, micro dispensers; and the like. Further options which may be used include recording apparatuses which spray lubricating oil at pinpoints onto watches, cameras, and other precision instruments; recording apparatuses for spraying an ultraviolet curing resin or another transparent resin liquid onto a substrate in order to form a microscopic semi-spherical lens (optical lens) or the like used in an optical communication element or the like; and recording apparatuses for spraying an acid, an alkali, or another etching liquid in order to etch a substrate or the like. The present invention can be applied to any one of these types of recording apparatuses.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A conveying apparatus comprising:

a holding part that holds a rectangular recording medium in the form of a roll wound up in a roll shape, the holding part being configured to rotate integrally with the roll about an axis of the roll;

a clamping unit that clamps the recording medium downstream from the holding part along a conveying route to convey the recording medium, the recording medium being clamped between a roller member configured to rotate while in contact with one surface of the recording medium and a contact member configured to come in contact with the other surface of the recording medium;

a regulating member that regulates a position of a side end of the recording medium in a width direction intersecting the conveying direction by coming in contact with the side end of the recording medium between the holding part and the clamping unit in the conveying route;

a drive unit configured to rotatably drive the holding part in a forward direction to unwind the recording medium from the roll and a reverse direction to rewind the recording medium into the roll; and a controller that controls a drive state of the drive unit so that, after the holding part is driven forward until a leading edge of the recording medium reaches a first conveying position downstream from the clamping unit, the holding part is driven in reverse until the leading edge of the recording medium moves from the first conveying position and reaches a second conveying position downstream from the clamping unit and upstream from the first conveying position.

2. The conveying apparatus according to claim 1, wherein the roller member is driven to rotate in order to convey the recording medium along the conveying route from the upstream side to the downstream side in the forward direction when the drive unit drives forward, and the drive rotation of the roller member is cancelled when the drive unit drives in reverse, allowing the roller member to be rotatably driven so as to rotate on making contact with the recording medium conveyed along the conveying route from the downstream side to the upstream side in the reverse direction.

3. The conveying apparatus feeding apparatus according to claim 1, further comprising a detecting unit that detects a position of the leading edge of the recording medium, the controller controlling the drive unit on the basis of detection results obtained from the detecting unit.

4. The conveying apparatus according to claim 2, further comprising a conveying roller that conveys the recording medium in the forward direction by being rotatably driven while in contact with the recording medium between the clamping unit and the holding part in the conveying route, when the drive unit drives in reverse, the drive rotation of the conveying roller being cancelled and the conveying roller being rotatably driven so as to rotate due to contact with the recording medium conveyed in the reverse direction.

5. A recording apparatus comprising:

a recording head configured to perform recording on the recording medium; and the conveying apparatus according to claim 1.

6. A conveying method performed in a conveying apparatus configured to convey a rectangular recording medium in both a forward direction from an upstream side to a downstream side along a conveying route and a reverse direction from a downstream side to an upstream side, the conveying method comprising:

rotating a holding part, which holds the recording medium in the form of a roll wound up into a roll shape and rotates integrally with the roll, about an axis of the roll in a forward direction for conveying the recording medium in the forward direction to convey the recording medium until a leading edge of the recording medium reaches a first conveying position farther downstream in the conveying route than a clamping unit that clamps the recording medium downstream in the conveying route from the holding part; and rotating the holding part in a reverse direction for conveying the recording medium in the reverse direction while a regulating member is brought in contact with a side end of the recording medium in a width direction intersecting the conveying direction between the holding part and the clamping unit in the conveying route, so that the position of the side end of the recording medium is regulated, whereby the recording medium is conveyed until the leading edge of the recording medium moves from the first conveying position and reaches a second conveying position downstream from the clamping unit and upstream from the first conveying position.

* * * * *